United States Patent [19]

Griffith

[11] Patent Number: 4,463,718

[45] Date of Patent: Aug. 7, 1984

[54] LUBRICANT METERING SYSTEM FOR ROTARY INTERNAL COMBUSTION ENGINE

[75] Inventor: Michael J. Griffith, Rutherford, N.J.

[73] Assignee: Deere & Company, Moline, Ill.

[21] Appl. No.: 438,394

[22] Filed: Nov. 1, 1982

[51] Int. Cl.[3] ..... F01C 21/04

[52] U.S. Cl. ..... 123/242; 418/88; 418/97

[58] Field of Search ..... 123/206, 242, 196 R; 418/88, 97, 98, 99

[56] References Cited

U.S. PATENT DOCUMENTS

| | | | |
|---|---|---|---|
| 2,977,939 | 4/1961 | Fearing | 123/206 |
| 3,196,847 | 7/1965 | Kimberley et al. | 123/206 X |
| 3,245,386 | 4/1966 | Bentele | 418/99 |
| 3,451,381 | 6/1969 | Armstrong | 123/243 |
| 3,834,844 | 9/1974 | Morgan | 418/88 X |

FOREIGN PATENT DOCUMENTS

| | | | |
|---|---|---|---|
| 2816384 | 10/1979 | Fed. Rep. of Germany | 123/196 R |

*Primary Examiner*—Michael Koczo

[57] ABSTRACT

The lubricant metering system for a rotary internal combustion engine has a lubricant metering device connected to the engine to communicate with the working chambers of the engine during the compression phase of operation thereof and is in communication with a source of lubricant to receive lubricant to be metered from the latter in a lubricant reservoir. The lubricant metering device is also connected to deliver metered lubricant from the lubricant reservoir to a place of use in the engine. A differential pressure sensing means is provided in the lubricant metering device to sense the differential gaseous fluid pressure in the working chamber and the lubricant pressure in the lubricant reservoir and to displace lubricant from the lubricant reservoir in response to engine speed and load demand.

11 Claims, 4 Drawing Figures

LUBRICANT METERING SYSTEM FOR ROTARY INTERNAL COMBUSTION ENGINE

This invention relates to a lubricant metering system for a rotary piston internal combustion engine of the Wankel type disclosed in the U.S. patent to Wankel et al U.S. Pat. No. 2,988,065 and more particularly to an automatic lubricant metering system for a throttle controlled rotary internal combustion engine of the aforesaid type.

BACKGROUND OF THE INVENTION

In rotary internal combustion engines of the Wankel type, such as exemplified in the aforesaid Wankel et al patent, the engine is provided with a housing or casing within which a rotor is eccentrically supported for planetating rotation relative to the housing. It is necessary in such engines to lubricate the inner housing wall surfaces, particularly the inner trochoidal surface which defines with the other wall surfaces the housing cavity within which the rotor rotates, the inner trochoidal surface being a surface against which bear apex seals carried at the apex portions of the rotor. To minimize frictional wear of the apex seals and the inner trochoidal surface and to provide improved sealing effectiveness, various lubricating systems have been devised such as exemplified in the following U.S. patents:

Scherenberg U.S. Pat. No. 3,193,053
Bentele U.S. Pat. No. 3,245,386
Bensinger et al U.S. Pat. No. 3,420,214
King et al U.S. Pat. No. 3,771,903
Lamm U.S. Pat. No. 3,809,021
King U.S. Pat. No. 3,811,806
Casey U.S. Pat. No. 3,814,555
Dobler U.S. Pat. No. 3,844,691
Hackbarth U.S. Pat. No. 3,911,870
Loyd, Jr. U.S. Pat. No. 3,990,818

In each of these patented systems it is necessary to accurately control the amount of lubricant in accordance with varying engine operating requirements. None of these systems has satisfactorily accomplished this control for both speed and load of the engine.

Accordingly, it is an object of this invention to provide a lubricant metering system for a rotary internal combustion engine which accurately controls lubricant flow automatically in accordance with engine speed and load. Another object of the present invention is to provide a lubricant metering system for a rotary internal combustion engine which is capable of accurately controlling small quantities of lubricating oil. A still further object of this invention is to provide a lubricant metering system for a rotary internal combustion engine which is capable of controlling lubricant flow under varying engine speed and load conditions and at the same time is relatively simple in construction and inexpensive to fabricate.

SUMMARY OF THE INVENTION

Accordingly, the present invention contemplates an improved lubricant metering system for rotary internal combustion engines of the type having a housing forming a housing cavity within which a rotor is eccentrically supported for planetary rotation and which rotor defines with the housing a plurality of working chambers. These working chambers successively expand and contract in volumetric size as the rotor planetates within said housing cavity so that each working chamber goes through a compression phase of operation where gaseous fluid (fuel and air) is compressed and is, therefore, at a relatively high pressure. Thereafter, the gaseous fluid is ignited in a combustion or expansion phase which is then followed by an exhaust phase of operation where the spent combustion gases are discharged. Following the exhaust phase of operation, each working chamber enters the intake phase where air and/or mixture of air and fuel is sucked into the working chamber.

The improved lubricant metering system in its broadest aspect comprises a source of lubricant which may be a conventional oil pump driven off the mainshaft of the engine. A metering device is provided which has a lubricant reservoir therein connected to the source of lubricant to receive lubricant from such source. The lubricant reservoir is also connected to deliver lubricant to a place of lubricant use, as for example the housing cavity to lubricate the interior surfaces of the housing. The metering device has a pressure differential sensing element which is in communication with the working chambers and is responsive to the fluid pressure in the working chambers during the compression phase of operation thereof to cause displacement of the lubricant in the lubricant reservoir and flow thereof to said place of use in accordance with engine speed.

In a narrower aspect of this invention, where the engine is provided with a throttle control means or is an unthrottled, fuel injection type engine, the metering device has a stop means coacting with the pressure differential sensing element to vary the amount of lubricant passed from the lubricant reservoir in accordance with engine load.

A feature of this invention is the pressure differential sensing element being a piston reciprocally mounted in a cylinder and where the cylinder and one side of the piston defines the lubricant reservoir. A passageway means is provided for communicating the cylinder on the side of the piston opposite from the lubricant reservoir with the working chambers in the area of the engine housing where the working chambers are in the compression phase of operation.

BRIEF DESCRIPTION OF THE DRAWINGS

The invention will be more fully understood from the following detailed description thereof when considered in connection with the accompanying drawings wherein an embodiment of the invention is illustrated by way of example and in which.

DESCRIPTION OF THE PREFERRED EMBODIMENTS

Figure 1:
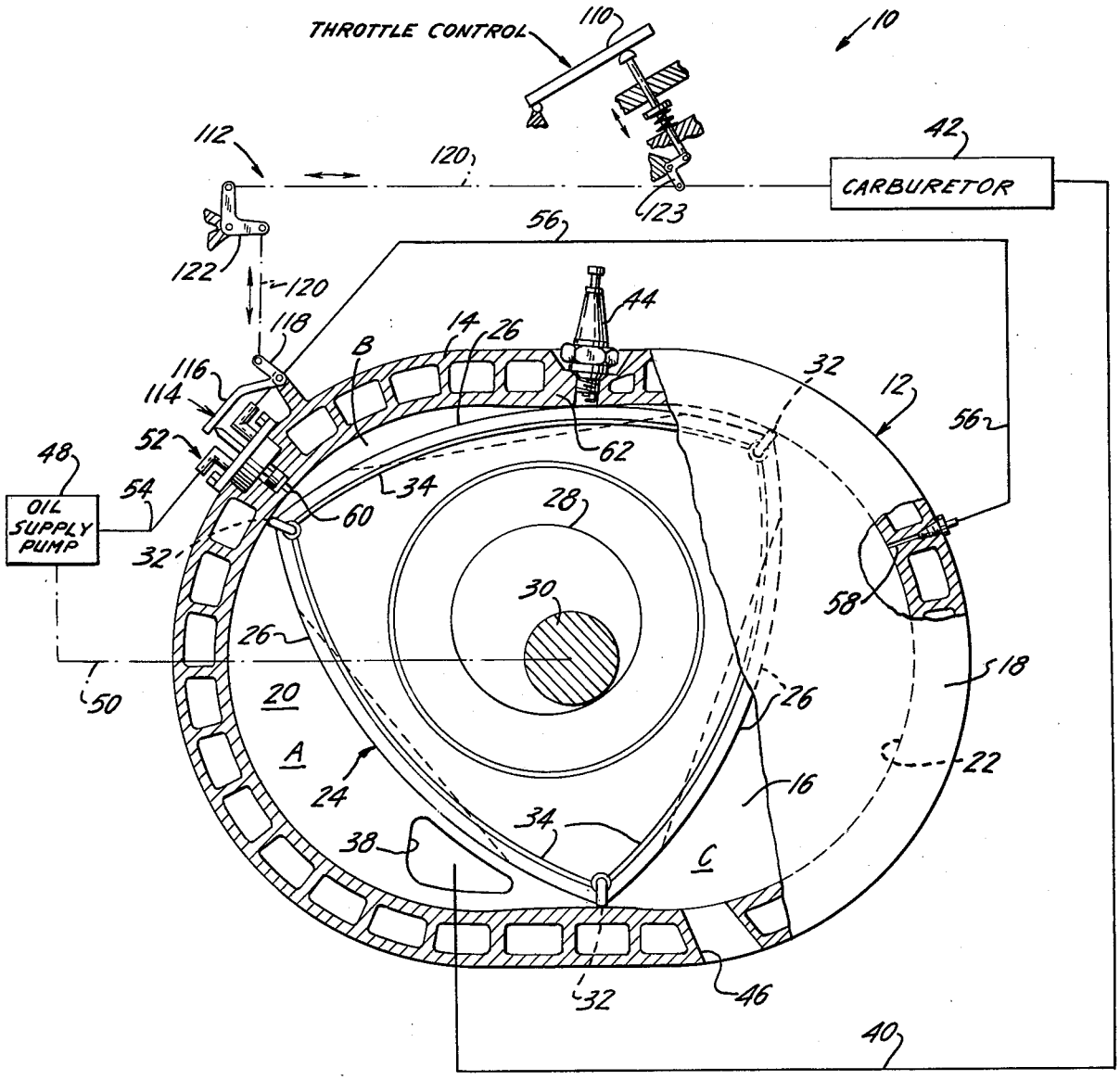
FIG. 1 is a diagramatic view of the lubricant metering system for a rotary internal combustion engine.

Now referring to the drawings and, more particularly to FIG. 1, the reference number 10 generally designates the lubricant metering system according to this invention. It is a system particularly adapted to a rotary piston, internal combustion engine and is shown for illustration purposes applied to a Wankel type rotary internal combustion engine 12 which is fully disclosed in the U.S. patent to Wankel et al U.S. Pat. No. 2,988,065.

The rotary internal combustion engine 12, which is schematically shown in FIG. 1, generally comprises a housing consisting of an intermediate wall 14 disposed between opposite end walls 16 and 18 to define a housing cavity 20. The intermediate wall is so formed as to provide a trochoidal shaped inner peripheral surface 22. A rotor 24 of generally triangular profile and having three flank surfaces 26 which intersect each other to form apex portions, is supported in the housing cavity 20 on an eccentric portion 28 of a mainshaft or crankshaft 30. The rotor 24 defines with the inner surfaces of housing walls 14, 16 and 18 a plurality of working chambers A, B and C, each which, as rotor 24 planetates relative the housing, successively expand and contract in volumetric size. To seal the working chambers from each other and the ambient atmosphere, a seal grid is provided on the rotor which includes apex seals 32, side seals 34 and oil seals 36. A side intake port 38 is provided in end wall 16 which port is connected through suitable passageway means (schematically shown as a line 40) to a source of fuel and air such as a carburetor 42. An ignition means, as for example a spark plug 44, is secured in intermediate housing wall 14 to ignite the compressed mixture of gaseous fluid in working chamber B. An exhaust port 46 is also provided in intermediate housing wall 14 to pass spent products of combustion out of working chamber C. To minimize friction and wear and to assist in cooling engine 12, engine 12 is lubricated in any suitable manner which may, as shown, include an oil pump 48 driven by the mainshaft 30 by any suitable means schematically represented by broken line 50. It is well known in a rotary internal combustion engine, of the Wankel type that it is desirable to lubricate the trochoidal surface 22 to improve sealing at the apices of the rotor and reduce wear of apex seals 32 which slidingly engage surface 22 as the rotor planetates within the housing. Accordingly, an improved lubrication metering system 10, according to this invention, is provided for engine 12.

Figure 4:
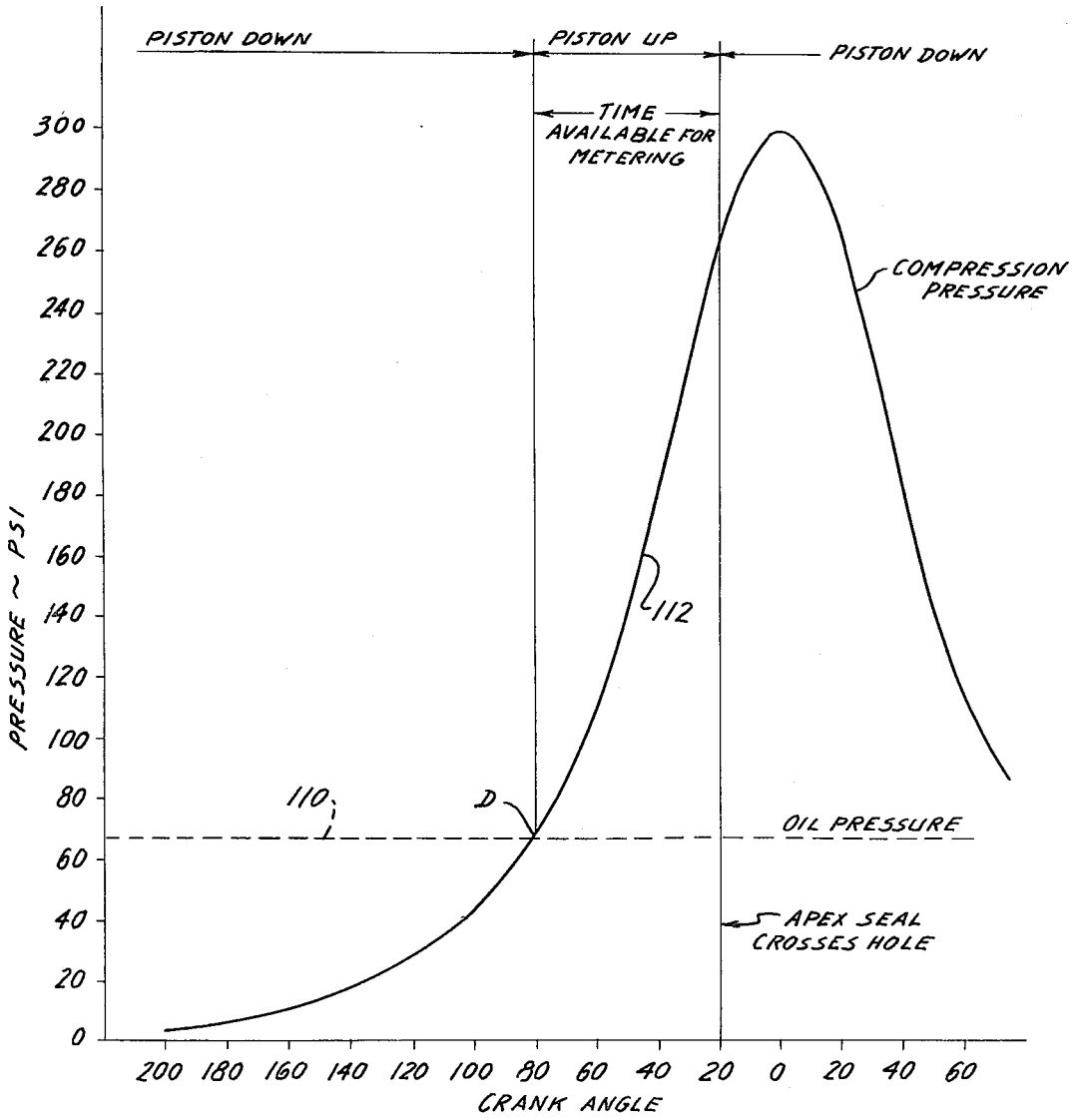
FIG. 4 is a graph showing the pressure variation of the gaseous fluid in the working chambers during the compression and ignition phases of operation relative to crankangle.

The metering system 10 generally comprises a metering device 52 which is connected through a pipe 54 to oil pump 48 to receive lubricant from the latter. The metering device is also connected via a pipe 56 to conduct metered lubricant from metering device 52 to a metering port 58 in the surface 22 of intermediate housing wall 14. As is shown, metering device 52 is mounted on the intermediate housing wall 14 and is in communication with working chamber B, through a port 60. This port 60 is located approximately at a point where the apex seals 32 are at 20° before top dead center (TDC) of rotor rotation relative to housing cavity juncture 62. As illustrated in the graph of FIG. 4, this rotor position is where working chamber B is under the compression phase of operation and the gaseous fluid is of a pressure slightly below optimum pressure. The significance of this location of port 60 will be more fully discussed hereinafter.

Figure 2:
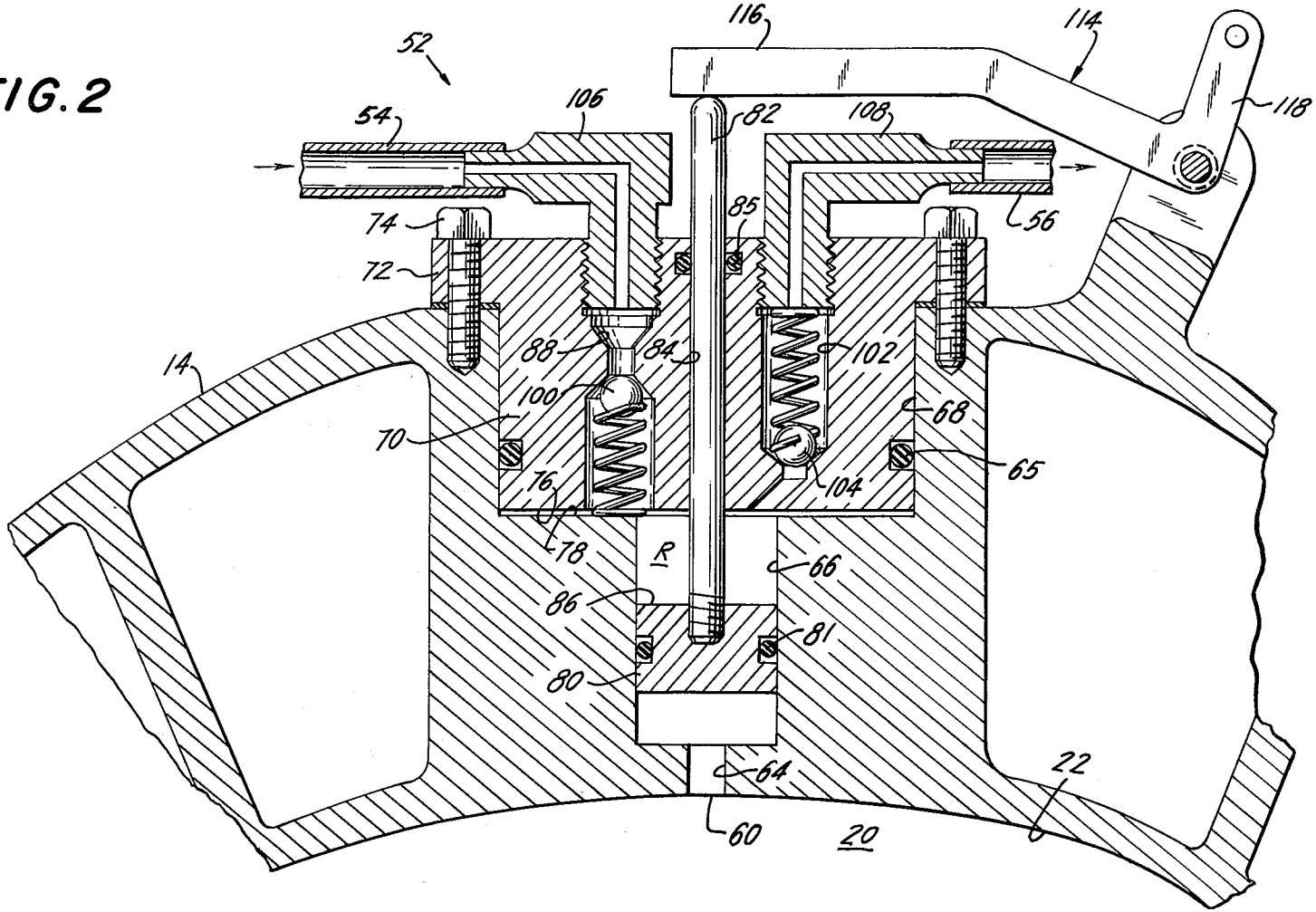
FIG. 2 is an enlarged fragmentary cross sectional view of the metering device shown in FIG. 1 and forming part of the lubricant metering system of this invention, the view of the metering device being rotated about 60° clockwise relative to the showing in FIG. 1.

As best shown in FIG. 2, metering device 52 comprises a bore 64 in intermediate housing wall 14, which bore terminates in port 60 at surface 22 of intermediate wall 14. The bore 64 is counterbored at 66 to form a piston cylinder cavity. The bore 64 is further counterbored at 68 to receive a valve body 70. The valve body 70 has a mounting flange 72 by which it is secured to intermediate wall 14 via a plurality of bolts 74. The valve body 70 is so sized relative to bore 68 that its inner distal end 76 is spaced from the surface of shoulder 78 formed at the juncture of counterbored portions 66 and 68.

A pressure differential sensing element, as for example a piston 80, is disposed for reciprocation in counterbore 66. The piston is guided in its reciprocative movement by a piston rod 82 which is supported in an axial bore 84 in valve body 70. The inner face 86 of piston 70 defines with the surface of counterbore 66 a lubricant reservoir R which receives lubricant via an inlet passageway 88 in valve body 70, the direction of flow therethrough being controlled by check valve 100 such as a spring biased, ball type shown in the drawing. An outlet passageway 102 is formed in valve body 70 to receive lubricant flowing from lubricant reservoir R. The flow of lubricant through outlet passageway 102 in a direction away from lubricant reservoir R is controlled by a check valve 104 which also may, as shown, be a check valve of the spring biased, ball type. The inlet passageway 88 and outlet passageway 102 are in communication with and connected to pipes 54 and 56, respectively, via connectors 106 and 108. The interstices between portion 80 and counterbored portion 66 is sealed by an O-ring 81 while the space between piston rod 82 and bore 84 is sealed by an O-ring 85. Also the interstices between valve body 70 and counterbored portion 68 are sealed by an O-ring 65.

The lubricant metering system 10 as thus far described functions automatically, and is speed sensitive, receiving one pulse for every full revolution of mainshaft 30 or as each flank surface 26 moves into a top dead center position. Assuming, as shown in FIG. 4 by broken line 110, that the pressure of the lubricant delivered to lubricant reservoir R of metering device 52 is about 66 psi and the gaseous fluid in each working chamber undergoes during the compression phase of operation and part of the expansion phase, the change in pressure depicted by line 112 in the graph of FIG. 4, a pressure differential is sensed by piston 80 beginning at D on the graph or when the rotor is at about 80° before top dead center. As the gaseous fluid is increasingly compressed in the working chamber piston 80 is forced upwardly in the piston cylinder cavity formed by counterbore 66. This movement forces lubricant from reservoir R, through passageway 102 by unseating check valve 104, and into pipe 56. The pipe 56 conducts the lubricant to metering port 58 and to the trochoid surface 22 of the engine housing. Of course, as lubricant is displaced in reservoir R, such lubricant cannot flow into inlet passageway 88 because of check valve 100. When the gaseous fluid pressure in the working chamber falls below the pressure of the lubricant in reservoir R, as sensed through port 60, the piston 80 moves downwardly or toward the engine cavity. This allows additional lubricant to enter reservoir R, via pipe 54, connector 106 and passageway 88, by unseating check valve 100. From the foregoing it is clear that lubricant metering system 10 provides an injection of a quantity of lubricant for each revolution of mainshaft 30. To make the lubricant metering system 10 also responsive to lubrication needs in accordance with load on the engine where such engine has a conventional throttle control 110 for carburetor 42, the system 10 is interconnected with throttle control 110 through a linkage system 112.

The linkage system 112 comprises a bellcrank type lever 114 pivotally connected to the engine housing adjacent metering device 52 and so constructed that one of its arms 116 is in contact with the distal end of piston rod 82. The other arm 118 of lever 114 is suitably connected to throttle control 110 or, in the case of an unthrottled, fuel injection engine, to the fuel control system (not shown), as for example the fuel injector gear rack such as disclosed in the U.S. Patent to Roberts et al U.S. Pat. No. 3,987,259. The connection is achieved by a motion transmitting means represented in FIG. 1 by the broken line 120 and may include two bellcrank type levers 122 and 123.

This interconnection of lubricant metering device 52 with the throttle control 110 functions to allow, per actuation of piston 80, the discharge of lubricant from lubricant reservoir R in an amount proportionate to the amount throttle control 110 is depressed in response to the load demand on the engine or, in the case of the unthrottled fuel injection engine, movement of the gear rack (not shown). In other words, lever arm 116 limits the upward, as viewed in FIG. 2, movement of piston 80 by piston rod 82 abutting lever arm 116. As the throttle 110 is moved to permit greater fuel flow from carburetor 42 into intake port 38 of the engine in response to load demand, lever arm 116 is simultaneously and automatically pivotally moved away from the piston rod to thereby allow greater movement of piston 80 and hence greater lubricant displacement out of lubricant reservoir R. Thus, the lubricant metering system 10 is responsive to both speed and load of the engine and provides the desired metered amounts of lubricant.

Figure 3:
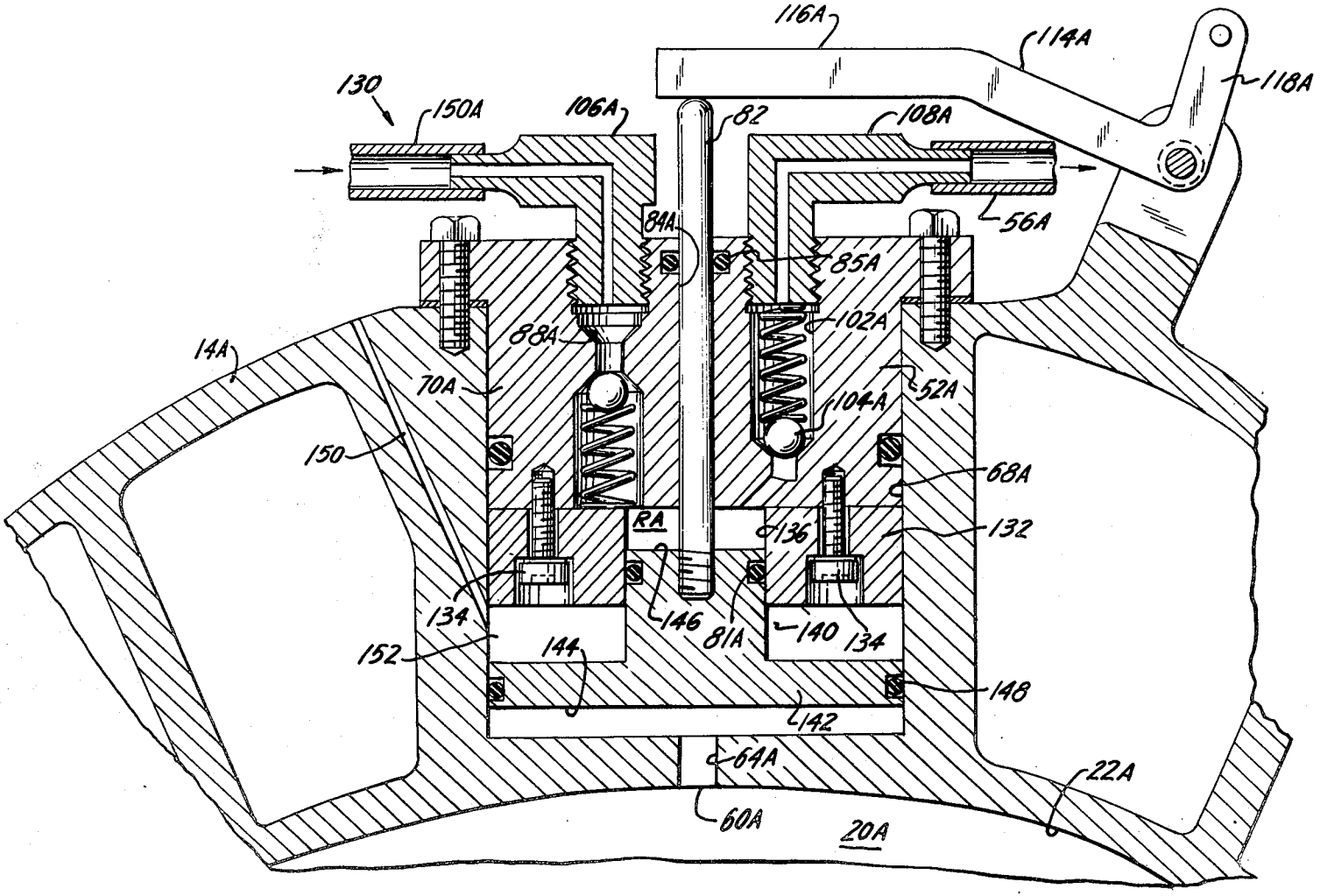
FIG. 3 is a view similar to FIG. 2 showing an alternative metering device which may form part of the lubricant metering system shown in FIG. 1.

In FIG. 3 is shown an alternative lubricant metering device 130 to lubricant metering device 52 shown in FIG. 2 which may be used in lubricant metering system 10. The essential difference between the lubricant metering devices 52 and 130 is that the pressure differential sensing means of lubricant metering device 130 provides a higher force differential across the piston for the same pressure differential than provided by the pressure differential sensing means of lubricant metering device 52. This feature is particularly desirable in an engine in which the air is throttled and therefore the gaseous fluid to be compressed in the working chambers is at times rarified and the piston actuating pressure is relatively low. Accordingly, parts of lubricant metering device 130, which are like parts of lubricant metering device 52, will be designated by the same number but with the suffix A added thereto.

As shown in FIG. 3, valve body 70A is secured to engine housing 14 in the same manner as valve body 70 of lubricant metering device 52 and projects into a counterbored portion 68A which extends inwardly of the housing to the same depth as counterbored portion 66 of metering device 52 so that there is one counterbore rather than the two of lubricant metering device 52. A ring shaped plate 132 is secured by screws 134 to the inner end of valve body 52A, the axial bore 136 of plate 132 forming part of the cylinder for piston 140. The piston 140 is of the stepped type having an enlarged portion 142 to provide an effective pressure surface 144 of substantially larger area than the pressure surface area 146 of the opposite end of piston 140. The enlarged portion 142 of piston 140 reciprocates within counterbored portion 68A while the other smaller portion of the piston reciprocates within bore 136. The pressure surface 146, the surface of axial bore 136 and the inner surface portion of valve body 70A define lubricant reservoir RA into which lubricant is received from a surface thereof such as pump 48 (see FIG. 1). The piston 140 is provided with a suitable seal, as for example an O-ring 148, in the peripheral surface of enlarged portion 142. A vent 150 is provided in housing 14 to communicate the area 152 between enlarged portion 142 of piston 140 and the exposed face of plate 132 with the atmosphere to avoid interference with the free reciprocation of piston 140 by compression of air in area 152.

The above described alternative lubricant metering device 130 has, compared to lubricant metering device 52, the following advantages:

1. the ability to increase the force differential between the gaseous fluid pressure from the working chambers acting against pressure surface 144 and the lubricant pressure in reservoir RA acting against pressure surface 146, thereby allowing more margin for establishing a predetermined opening pressure of check valve 104A;

2. more time for effective pumping and the less need for concern about friction losses at the seals 81A, 85A and 148; and 3. the ability to provide relatively small volumes of lubricant displacement from the lubricant reservoir and thus enable the accurate control of very small flows required by small displacement engines (low horsepower) for applications such as lawnmowers, chain saws and the like or in engines having apex seals which are in need of very little lubrication.

It is now believed readily apparent that the lubricant metering system 10 according to this invention provides metered lubricant to a place of use in a rotary piston internal combustion engine automatically in accordance with engine speed and load demand.

It is not the intention hereof to restrict applications of the invention by the figures and description thereof, but rather it should be understood that the present disclosure is to illustrate the concepts and principles of the present invention and that any changes or alterations hereto obvious to one skilled in the art would still come within the scope of this disclosure. Also, it should be understood that the figures are deliberately not drawn to scale and are exaggerated in some respect or schematically shown for clarity. Therefore, although one preferred embodiment of the present invention is herein disclosed, it should be obvious that the present disclosure is made by way of example only and that variations are possible without departing from the scope and spirit of this invention as the same will now be understood by those skilled in the art.

What is claimed is:

1. In a rotary internal combustion engine having a housing forming a housing cavity within which a rotor is eccentrically supported for planetary rotation and defining with the housing a plurality of working chambers which successively expand and contract in volumetric size as the rotor planetates within said housing cavity so that each working chamber goes through a compression phase of operation where gaseous fluid therein is compressed and is, therefore, at a relatively high pressure, an improved lubricant metering system comprising:

(a) a source of lubricant under pressure;

(b) a metering device having a lubricant reservoir therein connected to said source of lubricant to receive lubricant from such source and connected to pass lubricant from said lubricant reservoir to a place of use;

(c) said metering device having a pressure differential sensing element movable to vary the volumetric size of the lubricant reservoir and subject to fluid pressure in the working chambers and the lubricant reservoir and responsive to the differential fluid pressure between the fluid pressure in the working chamber and the fluid pressure in the lubricant reservoir so that during the compression phase of operation of the working chamber the pressure differential sensing element is moved to displace the lubricant in the lubricant reservoir and cause the displaced lubricant to flow to said place of use in accordance with engine speed, and (d) stop means coacting with the pressure differential sensing element to vary the amount of lubricant passed from the lubricant reservoir in accordance with engine load.

2. The engine of claim 1 wherein said source of lubricant is a lubricant pump driven by the engine.

3. The engine of claim 1 wherein said pressure differential sensing element is a piston reciprocally mounted in a cylinder, said cylinder and one side of said piston defining the said lubricant reservoir, a passageway means communicating the cylinder on the side of said piston opposite from the lubricant reservoir with the working chamber, said passageway means being located in the area where the working chambers are in the compression phase of operation.

4. The engine of claim 3 wherein a throttle control means is provided and wherein said pressure sensing element has a stop means to vary the reciprocative movement of said piston in response to actuation of the throttle control means so that the amount of lubricant displaced is in accordance with engine load and speed.

5. The engine of claim 3 wherein said source of lubricant is a pump driven by the engine and said pressure sensing element has an inlet port means communicating said lubricant reservoir with said lubricant pump to pass lubricant into the lubricant reservoir and an outlet port means communicating the lubricant reservoir with the place of lubricant use for passing lubricant from the lubricant reservoir to the latter.

6. The engine of claim 5 wherein flows of lubricant through said inlet and outlet port means are each controlled by check valves associated with the inlet and outlet port means.

7. In a rotary internal combustion engine having a housing forming a housing cavity within which a rotor is supported for planetary rotation and defining with the housing cavity a plurality of working chambers which successively expand and contract in volumetric size as the rotor planetates within said housing cavity so that each working chamber goes through a compression phase of operation where gaseous fluid therein is compressed and is, therefore, at a relatively high pressure, an improved lubricant metering system comprising (a) a metering device mounted on said housing;

(b) said metering device comprising (b-1) a cylinder forming a bore;

(b-2) a piston disposed for reciprocative movement in said cylinder bore and defining on one side of said piston with the cylinder bore a lubricant reservoir;

(b-3) inlet means communicating with a source of lubricant and with said lubricant reservoir to pass lubricant from the former to the latter;

(b-4) outlet means communicating at one end with said lubricant reservoir and at the opposite end with the housing cavity to pass lubricant to the latter;

(b-5) check valve means in said inlet and outlet means to insure lubricant flow in only one direction through said inlet and outlet means;

(b-6) a passageway means communicating said cylinder on the opposite side of said piston from the lubricant reservoir with the working chamber when the latter is in the compression phase of operation and thereby force the piston to move against the pressure of the lubricant in said lubricant reservoir and to force lubricant through said outlet means; and (b-7) stop means coacting with said piston to control the extent of movement of the piston in response to engine load.

8. The apparatus of claim 7 wherein said one side of said piston exposed to lubricant in said lubricant reservoir is of smaller surface area than the surface area of the opposite side from said one side adjacent the lubricant reservoir.

9. The engine of claim 8 wherein said engine has a throttle control operative between a fully open and a fully closed position in accordance with load demand on said engine and wherein said stop means includes linkage means interconnecting said metering device with the throttle control to thereby vary lubricant flow through said outlet means in accordance with engine load.

10. The engine of claim 9 wherein said stop means includes a stop element attached at one end to and reciprocal with said piston and at the opposite end in engagement with said linkage means to effect actuation of the latter upon reciprocative movement of the piston.

11. The apparatus of claim 10 wherein the stop element is a piston rod.

* * * * *